US005210346A

United States Patent [19]

Dileo

[11] Patent Number: 5,210,346

[45] Date of Patent: May 11, 1993

[54] SYNTHETIC LUBRICANT COMPOSITIONS WITH ALPHAOLEFIN DIMER

[75] Inventor: Thomas J. Dileo, Baton Rouge, La.

[73] Assignee: Ethyl Corporation, Richmond, Va.

[21] Appl. No.: 832,084

[22] Filed: Feb. 6, 1992

[51] Int. Cl.[5] ..... C10M 107/10

[52] U.S. Cl. ..... 585/10; 585/12; 585/510; 585/520

[58] Field of Search ..... 585/510, 520, 10, 12; 252/565

[56] References Cited

U.S. PATENT DOCUMENTS

| | | | |
|---|---|---|---|
| 3,742,082 | 6/1973 | Brennan | 260/683.9 |
| 3,763,244 | 10/1973 | Shubkin | 260/676 R |
| 4,175,046 | 11/1979 | Coant et al. | 585/10 |
| 4,239,638 | 12/1980 | Beretta et al. | 585/10 |
| 4,319,064 | 3/1982 | Heckelsberg et al. | 585/10 |
| 4,386,229 | 5/1983 | Heckelsberg et al. | 585/570 |
| 5,068,487 | 11/1991 | Theriot | 585/510 |

FOREIGN PATENT DOCUMENTS

| | | | |
|---|---|---|---|
| 0652680 | 11/1962 | Canada | 585/520 |

*Primary Examiner*—Jacqueline Howard
*Attorney, Agent, or Firm*—David M. Bunnell

[57] ABSTRACT

A synthetic oil composition comprises a major portion by weight of synthetic base oil having a kinetic viscosity of from about 1.5 to 2.5 cSt at 100° C. and a minor portion by weight of one or more property enhancing additives for said base oil, said base oil comprising a major portion by weight of dimer of 1-decene, said dimer having a kinetic viscosity of less than about 250 cSt at −40° C., a kinetic viscosity of less than about 1,000 cSt at −54° C. and a pour point of less than about −65° C.

12 Claims, No Drawings

SYNTHETIC LUBRICANT COMPOSITIONS WITH ALPHAOLEFIN DIMER

This invention relates generally to synthetic lubricant compositions and/or functional fluids and more specifically to low temperature synthetic oil compositions wherein the base oil contains a1-decene dimer which is prepared using a $BF_3$-water catalyst complex.

Alpha-olefin oligomers and their use as synthetic lubricants ("synlubes") are well-known. The oligomers are usually hydrogenated in order to improve their stability. Early reports of such synlubes are in Seger et al U.S. Pat. No. 2,500,161 and Garwood U.S. Pat. No. 2,500,163. The particular applications for which such oligomer oils are used depends upon their viscosity, with viscosities of about 2–10 cSt at 100° C. being preferred for general lubricating oil applications. Low viscosities, (e.g. 1–3 cSt at 100° C.) alpha-olefin dimer oils are especially useful in heat transfer, insulating, hydraulic and low temperature lubricant applications. Commercially available hydrogenated dimers prepared, for example, by oligomerizing 1-decene using a $BF_3$-butanol, or $BF_3$-propanol catalyst become cloudy and exhibit significant viscosity changes at −54° C. Such dimers fail to meet pour point and low temperature viscosity specifications for certain military uses due to the presence of relatively large amounts of linear isomers.

U.S. Pat. No. 5,068,487 discloses a dimerization process using $BF_3$-alcohol alkoxylate promoters which produces dimers having excellent very low temperature properties and, especially the −54° C. viscosity and the pour point, as described in copending application SN 736,242, filed Jul. 26, 1991. These dimers have improved very low temperature properties because they contain reduced amounts of the relatively linear isomers which are present in the $BF_3$-alkylalcohol produced dimers.

U.S. Pat. No. 3,763,244 describes a process for producing alpha-olefin oligomers having low pour points which process uses a $BF_3$-water complex. The dimer produced using $BF_3$-water complex catalysts is indicated to be the cause of high pour points. The process uses excess $BF_3$ in order to keep the amount of dimer in the oligomer product to below 10% so that the usual distillation step to remove excess dimer can be eliminated. Example 2, which does not use excess $BF_3$, produces 18.5% dimer or "a large amount of undesirable dimer". Examples 3 and 4 which use excess $BF_3$ produce only 6.5 and 2.6 percent dimer, e.g., less than 10% dimer, and the products are reported to have a low pour point without the need to remove dimer. I have now found that the dimer produced using a $BF_3$-water complex catalyst at temperatures of from about 25° to 50° C. has unique low temperature properties in that it has a low viscosity, not only at very low temperatures of −54° C., but also at −40° C., which makes it a superior base oil for low viscosity synthetic oil compositions for use in certain military lubricant and functional fluid applications in that it has a superior viscosity profile over a range of low temperatures.

In accordance with this invention there is provided a synthetic oil composition comprising a major portion by weight of synthetic base oil having a kinetic viscosity of from about 1.5 to 2.5 cSt at 100° C. and a minor portion by weight of one or more property enhancing additives for said base oil, said base oil comprising a major portion by weight of dimer of 1-decene, said dimer having a kinetic viscosity of less than about 250 cSt at −40° C., a kinetic viscosity of less than about 1,000 cSt at −54° C. and a pour point of less than about −65° C.

Also provided is a base oil for use in low temperature lubricant or functional fluid applications, such base oil consisting essentially of a hydrogenated dimer of 1-decene having a kinetic viscosity of about 1.7 cSt at 100° C., a kinetic viscosity of less than about 250 cSt at −40° C., a kinetic viscosity of less than about 1,000 at −54° C. and a pour point of less than about −65° C.

The dimer base oils for use in the lubricant compositions of the invention are prepared by oligomerizing 1-decene at a temperature of from about 25° C. to 50° C. water complex catalyst. Temperatures below about 25° C. do not produce dimer having the superior low temperature properties. Temperatures above 50° C. could be used but are preferably avoided so that the 80 to 90% of higher oligomer products which are coproduced with the dimer retain good properties for use as, for example, 4 and 6 cSt PAO's. The dimer content of the oligomer product can be maximized at about 12 to 25 weight percent while producing dimer of superior quality. After monomer removal, the dimer can be separated from the higher oligomers such as trimer and $C_{40}$+ oligomers by distillation. The dimer is then hydrogenated by conventional procedures using Pd, Pt or nickel catalysts under hydrogen pressures of from about 100–2000 psig at temperatures of from about 50–300° C.

The process is preferably carried out under a $BF_3$ atmosphere (5 to 500 psig) using a promoter amount of water. Promoter amounts of water range from about 0.01 to 10 grams per 100 grams of monomer feed and, preferably, about 0.05 to 1.0 grams per 100 grams of monomer. The process can be carried out in either a batch or a continuous method.

In forming the lubricant compositions the dimer can be used neat as a base oil or it can contain minor portions of lubricant oils such as higher alpha-olefin oligomers (trimer) or other synthetic lubricant oils such as, for example, synthetic esters, e.g., di-2-ethylhexyl adipate, trimethylolpropane tricaprioate and the like. Preferably the base oil contains 90 to 100 weight percent dimer. The lubricant compositions also contain a minor portion by weight of property enhancing additives for the base oils. By property enhancing additives is meant conventional type lubricant and functional fluid additives such as antioxidants, dispersants, antifoam agents, detergents, seal swell agents, friction reducers, extreme pressure additives, colorants, acid neutralizers, antiwear agents, corrosion inhibitors, metal passivators and the like. Specific examples of such agents include, but are not limited to, zinc dialkylthiophosphites or phosphates, calcium aryl sulfonates, overbased calcium aryl sulfonates, barium and sodium phenates, succinimides of ethylenepolyamines, sulfurized olefins, sulfurized phenols, hindered alkyl phenols, e.g. 2,6-di-tert-butylphenol, zinc dialkylphosphites or phosphates, silicone, alkoxylated amines, substituted aromatic amines, benzotriazole, 2,5-dimercaptothiadiazole and the like. The additives are usually used in amounts ranging from about 0.001 to 25 weight percent of total oil composition. The lubricant compositions can be prepared using conventional blending equipment.

The invention is further illustrated by, but is not intended to be limited to, the following examples.

EXAMPLE 1

A 1-decene dimer which meets stringent military grad specifications is prepared. The oligomerization is carried out in a stirred tank reactor. Alpha-olefin monomer, 19750 parts by weight of 1-decene, is pumped into the reactor which contain a atmosphere controlled at 2.7 barg and 10 parts by weight of water are fed continuously to the reactor over 1 hour. The reaction is allowed to proceed for another 2.75 hours for a total reaction time of 3.75 hours. Reaction temperature is controlled at 35° C. At the end of 3.75 hours, the crude reactor product is pumped to a separate surge drum where the reaction is killed with an excess amount of water. The following oligomer composition is obtained in weight percent.

| | |
|---|---|
| Monomer | 2.9 |
| Dimer | 18.9 |
| Trimer | 54.9 |
| $C_{40}$+ | 23.3 |

A sample is taken from the crude washed oligomer and distilled and hydrogenated. Physical properties for the individual hydrogenated distillation cuts are as shown in Table 1.

TABLE 1

| | Dimer | Trimer | $C_{40}$+ |
|---|---|---|---|
| Kin. Visc. @ | | | |
| 100° C. | 1.69 | 3.64 | 7.95 |
| 40° C. | 5.01 | 15.2 | 48.7 |
| −40° C. | 249 | 2007 | 21865 |
| −54° C. | 908 | — | — |
| Pour Point, °C. | <−70 | −72 | −56 |
| Flash Point (PMC), °C. | 142 | 194 | |
| Bromine No. | 0.085 | 0.03 | 0.03 |
| Noack Vol., Weight Percent Loss | — | 12.9 | — |

EXAMPLE 2

1-Decene is fed to the first of four stirred tank reactors arranged in series at a rate of 500 parts by weight per hour along with 0.26 part by weight per hour of water co-catalyst. All four reactors are controlled at 40° C. and 10 psig $BF_3$ pressure.

Total recovered products, excluding in process inventories, are as follows in parts by weight:

| | |
|---|---|
| Fuel (unreacted monomer) | 2,544 |
| Dimer | 10,492 |
| 4 cSt PAO | 45,564 |
| "Heavy 6" | 22,105 |

Dimer as the percent of recovered products is 13 weight percent. However, this number reflects startup and shutdown losses. Material balances during the middle of the run show an average dimer make of 14.4 weight percent. Table 2 gives the properties of the hydrogenated dimer.

TABLE 2

| | Dimer |
|---|---|
| Kin. Visc., cSt | |
| 100° C. | 1.7 |
| −40 | 246 |
| −54 | 982 |
| Pour Point, °C. | −68 |
| Flash Point, °C. | 161 |
| Bromine No. | 0.03 |
| Water, ppm | 24 |

EXAMPLE 3

A low temperature lubricant composition is prepared by blending 98 percent by weight of the dimer prepared in Example 2 with 2 percent by weight of 2,6-di-tert-butyl phenol as antioxidant.

What is claimed is:

1. A synthetic oil composition comprising a major portion by weight of synthetic base oil having a kinetic viscosity of from about 1.5 to 2.5 cSt at 100° C. and a minor portion by weight of one or more property enhancing additives for said base oil, said base oil comprising a major portion by weight of dimer of 1-decene, said dimer having a kinetic viscosity of less than 250 cSt at −40° C., a kinetic viscosity of less than 1,000 cSt at −54° C. and a pour point of less than about −65° C.

2. The synthetic oil composition of claim 1 wherein said dimer is hydrogenated.

3. The synthetic oil composition of claim 1 wherein said composition contains one or more property enhancing additives for said base oil selected from antioxidants, antiwear agents, dispersants, antifoam agents, detergents, seal swell agents, friction reducers, extreme pressure additives, colorants, acid neutralizers, corrosion inhibitors, anti-wear agents and metal passivators.

4. The synthetic oil composition of claim 3 wherein said composition contains a total of from about 0.001 to 25 weight percent of one or more property enhancing additives for said base oil.

5. The synthetic oil composition of claim 2 wherein said composition contains one or more property enhancing additives for said base oil selected from antioxidants, antiwear agents, dispersants, antifoam agents, detergents, seal swell agents, friction reducers, extreme pressure additives, colorants, acid neutralizers, corrosion inhibitor, anti-wear agents and metal passivators.

6. The synthetic oil composition of claim 5 wherein said composition contains a total of from about 0.001 to 25 weight percent of one or more property enhancing additives for said base oil.

7. The synthetic oil composition of claim 2 wherein said hydrogenated dimer is obtained by reacting 1-decene at a temperature of from about 25° C. to 50° C. using a $BF_3$-water complex catalyst, separating the 1-decene dimer from the reaction mixture and hydrogenating said dimer.

8. The synthetic oil composition of claim 1 wherein said base oil comprises from 90 to 100 weight percent of said dimer.

9. The synthetic oil composition of claim 2 wherein said base oil comprises from 90 to 100 weight percent of hydrogenated dimer.

10. The synthetic oil composition of claim 7 wherein said composition contains one or more property enhancing additives for said base oil selected from antioxidants, antiwear agents, dispersants, antifoam agents, detergents, seal swell agents, friction reducers, extreme pressure additives, colorants, acid neutralizers, corrosion inhibitor, anti-wear agents and metal passivators.

11. The synthetic oil composition of claim 10 wherein said composition contains a total of from about 0.001 to 25 weight percent of one or more property enhancing additives for said base oil.

12. A base oil for use in low temperature lubricant or functional fluid applications said base oil consisting essentially of a hydrogenated dimer of 1-decene having a kinetic viscosity of about 1.7 cSt at 100° C. a kinetic viscosity of less than about 150 cSt at −40° C., a kinetic viscosity of less than 1000 at −54° C. and a pour point of less than about 650° C.

* * * * *

UNITED STATES PATENT AND TRADEMARK OFFICE

CERTIFICATE OF CORRECTION

PATENT NO. : 5,210,346

DATED : May 11, 1993

INVENTOR(S) : THOMAS J. DILEO

It is certified that error appears in the above-identified patent and that said Letters Patent is hereby corrected as shown below:

In the Claims:

Col. 4, line 65, "...less than about 150 cSt..." should read

--...less than 250 cSt...--

Column 4, line 67, reads: " ...less than about 650°C. "

but should read: -- ...less than about -65°C. --

Signed and Sealed this

Third Day of May, 1994

Bruce Lehman

*Attest:*

BRUCE LEHMAN

*Attesting Officer*

*Commissioner of Patents and Trademarks*